United States Patent [19]

Cygnor et al.

[11] 3,961,859

[45] June 8, 1976

[54] CLUTCH CONNECTED MULTI-STAGE IMPELLER PUMP

[75] Inventors: John E. Cygnor, Middletown; Jack G. Sundberg, Meriden, both of Conn.

[73] Assignee: Chandler Evans Inc., West Hartford, Conn.

[22] Filed: Apr. 17, 1975

[21] Appl. No.: 568,905

[52] U.S. Cl. ..... 415/18; 415/123; 417/223

[51] Int. Cl.[2] ..... B27C 9/00

[58] Field of Search ..... 415/18, 123, 106; 417/223

[56] References Cited

UNITED STATES PATENTS

| | | | |
|---|---|---|---|
| 2,464,144 | 3/1949 | McConagny | 415/18 |
| 2,755,903 | 7/1956 | McAninch et al. | 195/85 AA |
| 3,576,375 | 4/1971 | Jackson | 415/18 |
| 3,663,117 | 5/1972 | Warren | 415/106 |

*Primary Examiner*—William L. Freeh
*Assistant Examiner*—G. P. LaPointe
*Attorney, Agent, or Firm*—Radford W. Luther; Richard A. Dornon

[57] ABSTRACT

A boost pump incorporates a low-flow impeller pump for charging the inlet of a gas producer fuel pump and a high-flow impeller pump for charging the inlet of an augmentor fuel pump. The low-flow pump is connected to a drive shaft so as to be continuously driven thereby. The drive shaft may be placed in driving connection with the high-flow pump through the medium of a friction clutch which is engageable by the application of a fluid pressure. Disengagement of the high-flow impeller, when augmentation is not required, significantly contributes to an increase in pump efficiency and a reduction in heating of the fluid being pumped.

4 Claims, 1 Drawing Figure

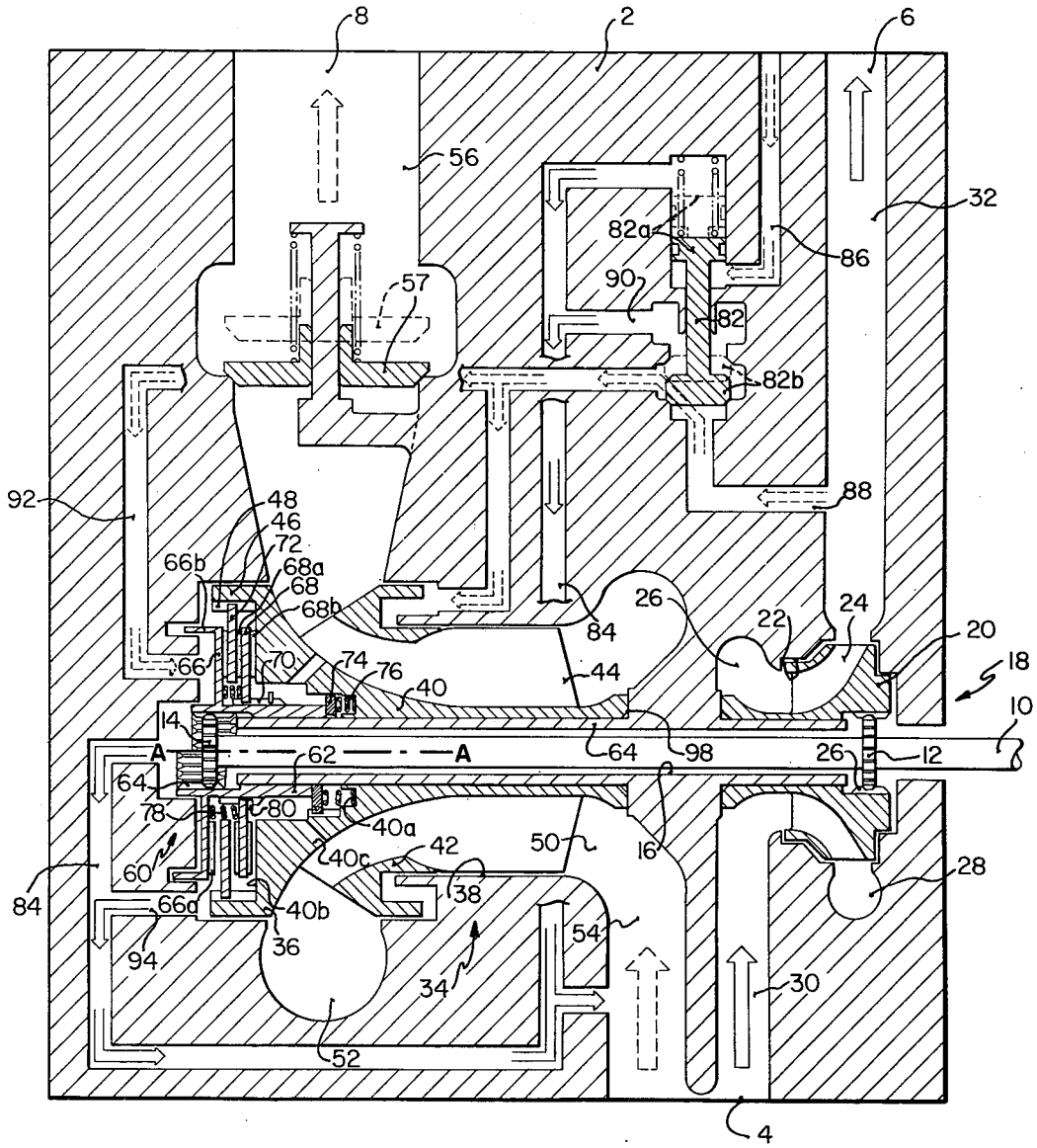
8
2
6
56
32
82a
86
90
57
82
82b
92
48
46
72
66b
68a
68
68b
88
84
26
22
24
20
18
66
70
74
76
40
44
10
14
A
62
A
64
98
26
12
64
78
80
40a
50
16
60
40c
42
28
84
66a
40b
38
54
94
36
34
30
52
4

CLUTCH CONNECTED MULTI-STAGE IMPELLER PUMP

BACKGROUND OF THE INVENTION

This invention relates to pumps and more particularly to pumping arrangements for gas turbine engine fuel controls.

Operation of a centrifugal pump a high turndown ratios (off design low-flow conditions) results in increased losses and heating of the fluid being pumped. Prior art solutions to this problem have included changing the impeller geometry at low flows and varying the collector inlet area.

SUMMARY OF THE INVENTION

The invention provides a pump having two impeller elements which may be either in series or parallel flow relationship. In order to improve pump efficiency and reduce fuel heating when only one pump is required to generate the necessary pressure, a friction clutch is provided to engage and disengage one of the impeller elements. A clutch of the invention not only permits engagement and disengagement at high speeds but also exerts a small resultant force on the impeller, whereby only a small thrust bearing is mandated.

In accordance with the invention, both impeller elements are driven by a common drive shaft when the clutch is engaged whereas when the clutch is disengaged only one of the elements is driven by the shaft.

Accordingly, it is a primary object of the invention to provide a pump having two drivingly interconnected impeller elements, one of which may be disconnected from the driving means.

It is another object to provide a boost pump for a gas turbine engine control which is adapted for efficient operation at high turndown ratios.

These and other objects and advantages of the invention will become more readily apparent from the following detailed description, taken in conjunction with the accompanying drawings, in which:

BRIEF DESCRIPTION OF THE DRAWING

The drawing shows a schematic view of a preferred pump of the invention.

DETAILED DESCRIPTION OF PREFERRED EMBODIMENT

The preferred embodiment of the drawing represents the boost stage of a pumping and metering system adapted to supply fuel to the burners and augmentor of a gas turbine engine (not shown). It will, however, be appreciated that a pump of the invention is not limited to such an application since there are instances where it is desirable to arrange two impeller pumps in series flow relationship.

The pump of the drawing comprises a housing 2 having an inlet 4 and two outlets 6 and 8 which respectively supply pressurized fuel to a gas producer pump (not shown) and an augmentor pump (not shown). The gas producer pump and the augmentor pump may be either variable speed or displacement metering pumps or fixed displacement pumps, each of which is associated with a metering control.

A drive shaft 10 having splined portions 12 and 14 is mounted for rotation in a cavity 16 in the housing 2. The drive shaft 10, which occupies a fixed axial location, is connected to the gear box of the gas turbine engine through suitable means so as to be driven thereby.

A first low-flow impeller pump, generally shown at 18, comprises an impeller element 20 mounted for rotation within a cavity 22 about an axis coincident with that of the shaft 10. The impeller element includes a hub and tip shroud which preferably carry an unshrouded axial inducer and a mixed-flow impeller blade, schematically shown at 24. The interior surface of the hub is provided with a plurality of splines 26 which are engaged by the splined portion 12 of the shaft 10. Fuel enters the first pump 18 through an inlet 26 and is discharged via a collector 28. The inlet 26 and the collector 28 respectively communicate with the housing inlet 4 and outlet 6 by means of conduits 30 and 32.

A second high-flow impeller pump, generally shown at 34, comprises an impeller element 36 mounted for rotation with a cavity 38 about an axis coincident with that of the shaft 10. The impeller element 36 includes a hub 40 and a tip shroud 42 which preferably carry an unshrouded axial inducer and a mixed-flow impeller blade, schematically represented at 44. A cylindrical extension 46 of the hub 40 carries a plurality of internal splines 48.

Fuel enters the pump 34 through an inlet 50 and is discharged to collector 52. Inlet 4 and collector 52 respectively communicate with housing inlet 4 and housing outlet 8 via conduits 54 and 56. A spring loaded poppet check valve 57 is inserted in conduit 56. Valve 57 is normally closed and opens when the pump 34 generates sufficient pressure.

A friction clutch, generally indicated at 60, serves to transmit torque from the drive shaft 10 to impeller element 36. The clutch 60 has a cylindrical hub 62 mounted for rotation and axial sliding movement upon a journal 64, which also supports the impeller element 36. The left end of the clutch hub 62 is furnished with a plurality of internal splines 64 which register with the voids defined between the splines on the splined portion 14 of the shaft 10. The splines 64 are in continuous engagement with the splined portion 14, whereby the shaft always drives the hub, irrespective of whether the clutch is engaged. The hub 62 also comprises an integral driving disc 66 of annular configuration to which is secured a friction surface **66*a*. Another driving disc 68, having annular friction surfaces 68*a* and 68*b* on either side thereof, is in splined engagement with external splines 70 fashioned on the clutch hub 62. A driven disc 72, having its outer periphery in engagement with internal splines on the extension 46 of impeller element 36, is disposed between the friction surfaces 66*a* and 68*a*. Abutting the right annular end surface of the clutch hub 62 is a washer 74 which is loaded thereagainst by a plurality of circumferentially distributed compression springs 76 mounted in cavities 40*a* in the hub 40. The washer 74 is keyed to the hub 40 and therefore rotates in unison therewith. The spring loading of the clutch hub functions to urge the disc 66 to the left. Separating compression springs 78 (which may be coil or wave springs), which urge the discs 66 and 68** away from each other, act to facilitate clutch disengagement.

Below the cutting plane A—A, the elements which constitute the clutch 60 are depicted in the respective positions which they occupy when the clutch is disengaged; and above the plane A—A, the elements are shown in the respective positions which they occupy when the clutch is disengaged. It will be noted that the clutch hub 62 moves to the left during clutch disengagement and to the right during clutch engagement.

When a sufficient fluid pressure is applied against the left side of the disc 66 (by means described hereinafter), the clutch hub 62 is displaced from its disengaged position to the right against the bias of spring 76. When the clutch hub 62 attains the engaged position, there is frictional engagement between discs 66 and 72 and between discs 72 and 68. In addition, such frictional engagement is engendered between disc 68 and the left face 40*b* of the hub 40. Hence, when the clutch is engaged the three discs and the impeller element 36 rotate in unison. Torque is then transmitted to the hub 40 at two locations, to wit, at the splines 48 and the face 40*b*.

When the fluid pressure which engages the clutch 60 is relieved (as is discussed hereinafter), spring 76 urges the disc 66 to the left toward its disengaged position. Spring 78 assists in this movement until the friction surface 68*b* departs from the face 40*b*. Separation between the surface 68*b* and the face 40*b* is effected when a ring clip 80, which is fixedly secured to the splines 70, contacts the inner periphery of disc 68 during leftward travel of the clutch hub 62. Of course, during further leftward travel of the clutch hub 62 and after the disengaged position of the hub 62 is achieved, spring 78 continues to cause the discs 66 and 68 to remain separated.

In order to facilitate clutch disengagement, and more importantly, to prevent clutch self-engagement in the absence of a fluid pressure acting on the disc 66, it is essential to provide a plurality of ports 40*c* in the hub 40 which fluidly interconnect the volume between the clutch hub 62 and a fluid pressure within the impeller which is slightly above inlet pressure. Such ports will prevent a high shaft speed from producing a pressure imbalance which causes clutch engagement.

The friction surfaces of the discs are preferably made of cast leaded bronze, sintered bronze, molded asbestos or molded paper fiber. A low carbon steel is a suitable material for the discs. Such materials are preferable from the standpoint of compatibility with gas turbine engine fuels. It will be understood that while the schematic drawing shows only two driving discs and one driven disc, (for the sake of simplicity), normally a third driving disc and a second driven disc would be required to transmit torque. Obviously, the number of discs required is mandated by the particular application.

A spring loaded selector valve 82 is mounted in housing 2 to control clutch engagement and disengagement. The upper surface of upper land 82*a* is referenced to inlet pressure by a conduit 84 while the lower surface of land 82*a* is exposed to a signal pressure, directed through signal pressure conduit 86. The underside of the land 82*b* is subjected to the discharge pressure from pump 18 which is transmitted through conduit 88. The upper surface of land 82*b* is exposed to inlet pressure via a branch conduit 90. When a pressure signal is directed through conduit 86, the valve 82 is displaced to its dashed line position, thereby establishing fluid communication between the conduit 88 and a conduit 92. The conduit 92 then directs the discharge pressure of the impeller pump 18 to the left face of disc 66, whereby the clutch 60 is caused to engage. It will be noted that the left end of the shaft 10 and the outer periphery of the clutch 60 are reference to inlet pressure via the conduit 84 and a branch conduit 94 which communicates therewith. However, it will be noted that a cylindrical extension 66*b*, projecting leftwardly, and the left outer periphery of the clutch hub 62 have a close running fit with the housing, thereby to seal the high pressure applied to the disc 66.

A branch conduit 96 directs the first impeller pump discharge pressure (when valve 82 is open) to the right side of the shroud 42 of the second impeller pump 34. The purpose of this arrangement is to subject the impeller element 36 to a leftward balancing force which opposes the rightward force applied thereto at the face 40*b* by the clutch disc pack. By balancing the forces in this manner, a thrust bearing at 98 (not shown) can be of minimal size, and furthermore, friction is reduced.

In operation, the low-flow impeller pump 18 operates continuously when the shaft 18 is rotated to supply fuel to the gas producer pump (not shown). When thrust augmentation is desired, a pressure signal opens valve 82 which results in engagement of the clutch 60 with the impeller element 36 of the high-flow impeller pump 34, whereby both pumps operate in unison. The flow from the high-flow pump 34 traverses valve 57 and proceeds to the augmentor fuel pump. Withdrawal of the pressure signal in conduit 86 causes valve 82 to return to its solid line position, whereby inlet pressure is applied to the left side of disc 66. The clutch 34 then disengages from the high-flow impeller element 36 and only the low-flow pump 18 continues to function.

Obviously, many modifications and variations are possible in light of the above teachings without departing from the scope or spirit of the invention, as defined in the appended claims.

We claim:

1. A pumping system comprising:

a first impeller pump having an inlet and an outlet;

a second impeller pump having an inlet and an outlet, the second impeller pump comprising: housing means, and an impeller element, having a hub, mounted for rotation within the housing means;

means to drive the first impeller pump, the drive means comprising: a splined drive shaft mounted within the housing means;

clutch means to connect the drive means to the second impeller pump to disconnect the drive means from the second impeller pump, the clutch means comprising: a pressure operated friction clutch in driving connection with the splined shaft and adapted to contact a surface on the hub during clutch engagement;

means to engage and disengage the clutch means for respectively connecting the second impeller pump to the drive means and disconnecting the second impeller pump from the drive means, the engaging and disengaging means comprising: means to apply a first fluid pressure to the clutch for engagement thereof, means to apply a second fluid pressure to the clutch which is higher than the inlet pressure for the second impeller pump to facilitate clutch disengagement and prevent clutch self-engagement in the absence of an application of the first fluid pressure, and a spring interposed between the clutch and the hub for urging the clutch to a disengaged position.

2. A pumping system, as defined in claim 1, wherein the hub comprises a plurality of internal splines and wherein the clutch engages the internal splines so that torque may be transmitted to the impeller element at two locations during clutch engagement.

3. A pumping system, as defined in claim 1, wherein the first fluid pressure applying means comprises:

means to communicate discharge pressure from the first impeller pump to the clutch.

4. A pumping system, as defined in claim 3, wherein there is further provided:

means to communicate the discharge pressure from the first impeller pump to the impeller element for partially balancing the force exerted thereupon by the clutch.

* * * * *